US007540713B1

(12) United States Patent
Marussich

(10) Patent No.: US 7,540,713 B1
(45) Date of Patent: Jun. 2, 2009

(54) THREADED ROTOR ASSEMBLY WITH A CENTRIFUGAL LOCK

(75) Inventor: Walter Marussich, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 442 days.

(21) Appl. No.: 11/508,012

(22) Filed: Aug. 21, 2006

Related U.S. Application Data

(60) Provisional application No. 60/711,916, filed on Aug. 26, 2005.

(51) Int. Cl.
*F01D 1/24* (2006.01)

(52) U.S. Cl. ..... 416/198 A; 416/198 R; 416/244 A; 416/244 R

(58) Field of Classification Search ..... 416/198 A, 416/198 R, 199, 244 A, 244 R
See application file for complete search history.

(56) References Cited

U.S. PATENT DOCUMENTS 2,105,317 A * 1/1938 Frank ..... 301/6.2
2,566,663 A * 9/1951 Hollerith ..... 301/6.7
2,619,317 A * 11/1952 Traupel ..... 416/95
2,654,565 A 10/1953 Feilden
2,795,371 A * 6/1957 Buchi, Sr. et al. ..... 416/171
3,589,149 A * 6/1971 Fischer ..... 301/5.307
3,846,044 A * 11/1974 Shank ..... 416/199
3,976,399 A 8/1976 Shmoch
4,009,846 A * 3/1977 Coruzzi ..... 242/356.3
4,086,690 A 5/1978 Bernasconi
4,247,256 A 1/1981 Maghon
4,432,697 A 2/1984 Miura et al.
4,477,227 A 10/1984 Klufas
4,509,900 A 4/1985 Odawara
4,844,694 A 7/1989 Naudet
5,388,963 A 2/1995 Dmmick, III et al.
5,860,789 A 1/1999 Sekihara et al.
5,865,600 A 2/1999 Mri et al.
6,152,697 A 11/2000 Konishi et al.

* cited by examiner

*Primary Examiner*—Igor Kershteyn
(74) *Attorney, Agent, or Firm*—John Ryznic

(57) ABSTRACT

A rotor disk assembly having a plurality of rotor disks secured together by annular projections with screw threads thereon for easy assembly and disassembly. The annular projections include a plurality of spring biased pins that push against an opposing annular projection due to centrifugal forces during rotation of the rotor disks at such a force as to hold the rotor disks against loosening from vibrations. The spring biased pins have a low enough spring constant that the pins are disengaged when enough torque is applied to unscrew the rotor disk from one another.

5 Claims, 2 Drawing Sheets

Fig. 2

THREADED ROTOR ASSEMBLY WITH A CENTRIFUGAL LOCK

CROSS-REFERENCE TO RELATED APPLICATIONS

This application claims the benefit to an earlier filed U.S. Provisional application 60/711,916 filed on Aug. 26, 2005 and entitled CENTRIFUGAL LOCK FOR THREADED ROTOR ASSEMBLY.

BACKGROUND OF THE INVENTION

1. Field of the Invention

The present invention relates generally to a multiple rotor disc assembly having a threaded connection, and more specifically to a threaded connection having a centrifugally engaging lock pin to prevent the threaded connection from loosening during operation. The present invention is directed to a rotor disc assembly of a gas turbine engine, but can be used in rotor discs of non-gas turbines.

2. Description of the Related Art Including Information Disclosed Under 37 CFR 1.97 and 1.98

Rotor disc assemblies are found in gas turbine engines or other turbomachinery such as compressors and pumps. When more than one row of blades is used, additional rotor discs are secured together and rotate as one unit. There are several well known methods of securing adjacent rotor discs together such as welding, bolting, and threading. The welded and bolted discs tend to remain secured together. However, the welded and bolted discs are generally difficult to separate for maintenance or repair of discs. Threaded discs are easy to assemble or disassemble, but can become loose from the rotational operation. What is needed is an easy method of securing adjacent rotor discs together that will maintain a secure connection, especially while rotation occurs, yet will provide for an easy assembly or disassembly of the discs when rotation has stopped.

U.S. Pat. No. 4,477,227 issued to Klufas on Oct. 16, 1984 and entitled KEYING FOR SHRUNK-ON TURBINE WHEELS shows a turbine rotor disk assembly in which the rotor disks are shrink fitted together to prevent relative rotation. This method of securing the rotor disks would not allow for easy disassembly and prevent loosening of the assembled rotor disks during operation.

U.S. Pat. No. 5,388,963 issued to Dimmick, III et al on Feb. 14, 1995 entitled FLANGE FOR HIGH SPEED ROTORS shows rotor disks fastened together by a plurality of nut and bolt assemblies. This type of connection is somewhat easy to disassemble the rotor disks. However, the present invention provides for an even easier disassembly. Also, the nut and bolt assembly can come loosened due to the vibrations during operation. The present invention provides for an improved method of preventing loosening of the rotor disks during rotation.

U.S. Pat. No. 5,860,789 issued to Sekihara et al on Jan. 19, 1999 entitled GAS TURBINE ROTOR shows a plurality of rotor disks fastened together in an axial direction by stacking bolts. The stacking bolt passes through the entire series of rotor disks. Therefore, to disassembly one rotor disk requires that all rotor disks be disassembled. Also, the stacking bolts could come loosened from vibrations during rotation.

BRIEF SUMMARY OF THE INVENTION

The present invention provides for an apparatus to easily secure two adjacent rotor discs together while maintaining the secure connection during operation. This objective is provided by threadably engaging the rotor discs together and including a centrifugally biased pin that engages the threaded rotor discs to prevent the threaded engagement from loosening during operation, but allow for the biased pin to be displaced out of the groove when the rotor discs are disassembled. The holding force of the biased pin increases with rotation of the discs, and decreases to a force provided by a biasing spring when the discs are not rotating, allowing for the pin to be displaced out of engagement to unthread the rotor discs.

DETAILED DESCRIPTION OF THE INVENTION

Figure 1:
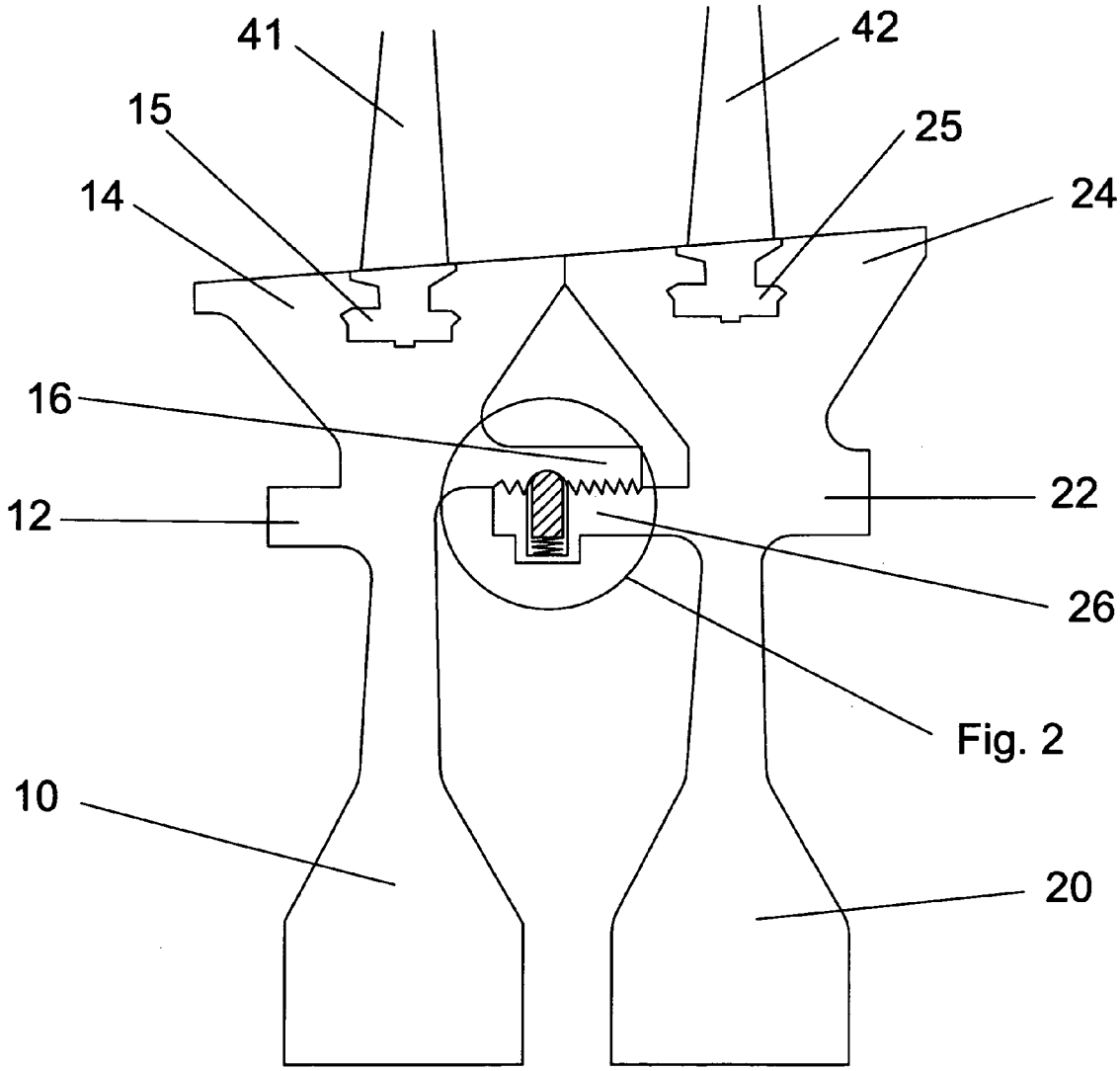
FIG. 1 shows a cross section view of two rotor discs having a threaded connection between adjacent discs, with a locking pin to prevent loosening of the threaded engagement.

Referring now to FIG. 1, the present invention is shown with two rotor discs stacked to form a rotor assembly of a compressor section in a gas turbine engine. A first rotor disc 10 includes a forward annular projection 12, a disc platform 14 having a blade slot 15 therein, a rearward annular projection 16 having a threaded portion on the underneath surface, and a dome 18 directed toward the longitudinal axis of the turbine. A compressor blade 41 having a root is secured to the rotor disc 10 within the slot 15.

A second rotor disc 20 has similar structure to the first rotor disc 10, but with a different radial length due to the increasing size of the blades in the compressor. The second rotor disc 20 includes a forward annular projection 26 with a threaded surface on the upper face that engages the threaded portion on the annular projection 16 of the first rotor disc 10. The second rotor disc 20 includes a rearward annular projection 22, a platform 24 with a slot 25, and a second compressor blade 42 having a root secured in the slot 25. The annular projection 26 of the second rotor disc 20 also includes a pocket 28 in which a pin 30 biased in a radial outward direction by a spring 32. A plurality of these pockets and pins are arranged circumferentially around the annular projections 16 and 26 of the two rotor discs.

Figure 2:
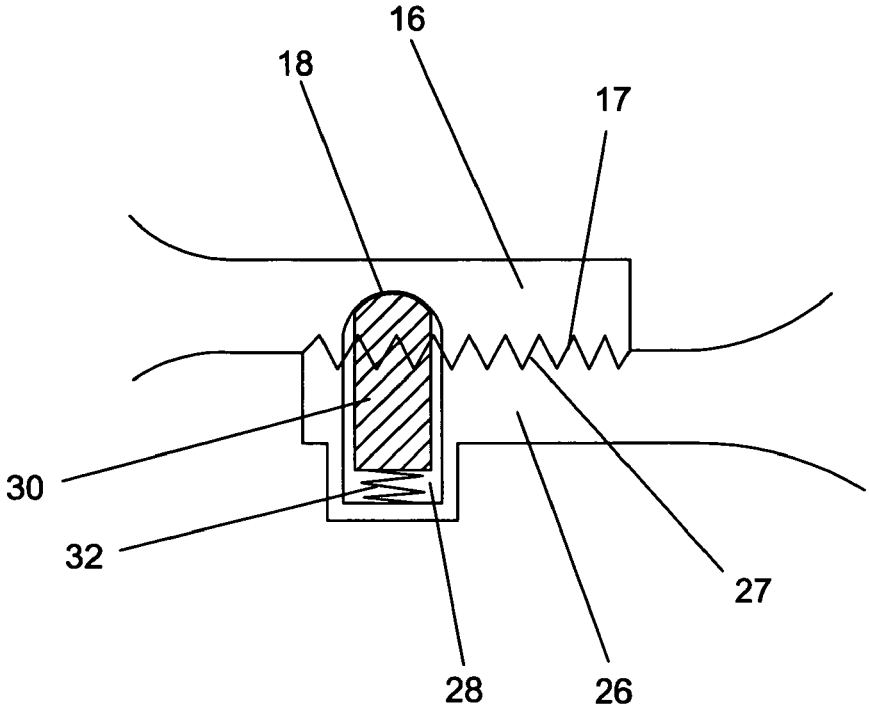
FIG. 2 shows a detailed view of the locking mechanism used in the rotor disc assembly.
Figure 3:
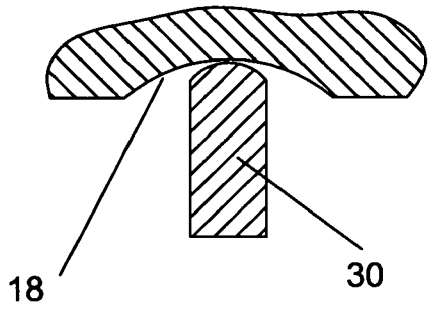
FIG. 3 shows a cross section view of the dome surface and the pin 90 degrees from the view in FIGS. 1 and 2.

Details of the shape of the dome 18 and the pin 30 head are shown in FIGS. 2 and 3. The pin 30 includes a head having a generally rounded curvature while the dome 18 is significantly wider than the head of the pin 30 as shown in FIG. 3. The dome 18 is of such a wider curvature than the width of the pin to allow for the pin 30 head to slide along the dome surface when enough of a rotation force exists between the two rotor discs. When the rotor disc assembly is not being rotated, the dome 18 should allow for the pin 30 head to slide along the surface and permit relative rotation between the threaded portions of the discs. When the centrifugal force acting on the pin 30 is large enough, the curvature of the dome 18 is enough to prevent the pin 30 head from sliding along the dome surface.

Operation of the locking capability of the pins is described next. When the rotor discs 10 and 20 are not rotating, the pin 30 is biased against the dome 18 by the spring 32, which provides a small bias force. First rotor disc 10 can be threadably unengaged from the second rotor disc 20 by rotating one of the discs with respect to the other. The small bias by the spring 32 will not provide a force to hold the pin 30 against the dome 18 to prevent relative rotation of the two discs. When the rotor disc assembly is rotating at normal speeds, the pin 30 is forced up against the dome by the centrifugal force that results from the rotation. Because the pin 30 has mass, the centrifugal force will depend upon both the mass of the pin 30 and the rotational speed of the discs. A typical IGT turbine rotor assembly will rotate at 3600 rpm, with higher speeds for an aero engine. The resulting centrifugal force pushes the pin 30 up against the dome 18 with enough force to prevent relative rotation between the two discs.

The number of pins 30 used per rotor disc can vary depending upon the amount of centrifugal force required to prevent relative rotation between discs such that the threaded connection loosens.

The present invention is disclosed for use in a compressor section of the turbine engine. However, the pin and dome locking arrangement can also be used in the turbine rotor discs, or in discs other than gas turbine engine discs. Any rotating disc arrangement that uses a threaded connection to join adjacent discs can make use of this particular invention. The pins and dome would provide a locking force to prevent threaded engagement from loosening, and allow for the discs to be easily disassembled by unscrewing the threaded members.

I claim the following:

1. A rotor disk assembly comprising:

a first rotor disk having a first annular projection;

a second rotor disk having a second annular projection extending toward the first annular projection;

the first and second annular projections having screw threads that engage together to hold the two rotor disks together; and, a spring biased pin to prevent relative rotation between the two rotor disks during rotation;

the lower-most annular projection having a pocket in which the spring biased pin is placed; and, the upper-most annular projection includes a dome in which the pin engages to prevent relative rotation between the two rotor disks.

2. The rotor disk assembly of claim 1, and further comprising:

the pin includes a head having a curvature less than a curvature of the dome.

3. The rotor disk assembly of claim 1, and further comprising:

the spring biased pin has a mass such that rotation of the rotor disk assembly produces a centrifugal force on the pin such that the pin engages the outer annular projection with enough force to prevent relative rotation of the rotor disks.

4. A rotor disk assembly comprising:

a first rotor disk having a first annular projection;

a second rotor disk having a second annular projection extending toward the first annular projection;

the first and second annular projections having screw threads that engage together to hold the two rotor disks together;

a spring biased pin to prevent relative rotation between the two rotor disks during rotation; and, a plurality of spring biased pins circumferentially spaced around the annular projections of the rotor disks.

5. A rotor disk assembly comprising:

a first rotor disk having a first annular projection;

a second rotor disk having a second annular projection extending toward the first annular projection;

the first and second annular projections having screw threads that engage together to hold the two rotor disks together; and, a spring biased pin to prevent relative rotation between the two rotor disks during rotation; and, the spring has a spring constant such that the pin retracts when, enough torque is applied to unscrew the rotor disk assembly.

* * * * *